US005507208A

United States Patent [19]

Pratt

[11] Patent Number: 5,507,208

[45] Date of Patent: Apr. 16, 1996

[54] CONVERSION RATCHET DRIVE

[76] Inventor: Floyd L. Pratt, 509 Patty Rd., Knoxville, Tenn. 37924

[21] Appl. No.: 488,580

[22] Filed: Jun. 8, 1995

[51] Int. Cl.[6] ..... B25B 13/46; B25B 13/58

[52] U.S. Cl. ..... 81/60; 81/177.85; 81/185

[58] Field of Search ..... 81/177.85, 185, 81/60, 61, 62, 63, 63.1, 63.2, DIG. 11, 177.1, 177.2

[56] References Cited

U.S. PATENT DOCUMENTS

| | | | |
|---|---|---|---|
| 1,171,063 | 2/1916 | Nigborowicz | 81/185 |
| 1,807,134 | 5/1931 | Pfauser . | |
| 1,873,472 | 8/1932 | Pfauser . | |
| 2,803,980 | 8/1957 | Vogel | 81/62 |
| 3,490,317 | 1/1970 | Rozmus | 81/62 |
| 3,815,451 | 6/1974 | Penner | 81/177.85 |
| 4,027,558 | 6/1977 | Fish | 81/185 |
| 4,631,989 | 12/1986 | Trowbridge et al. | 81/62 |
| 5,211,087 | 5/1993 | Thomason | 81/63.2 |
| 5,361,656 | 11/1994 | Starr | 81/177.85 |

*Primary Examiner*—Bruce M. Kisliuk

*Assistant Examiner*—Joni B. Danganan

*Attorney, Agent, or Firm*—Pitts & Brittian

[57] ABSTRACT

A conversion ratchet drive (10) for use with socket wrenches having various sizes of ratchet receptors, the ratchet (10) being provided with at least one output shaft sleeve (30) for effectively adjusting the side length thereof. The ratchet (10) is provided with an output shaft (16) which extends from the same side of the ratchet head (14) as each of the output shaft sleeves (30). The ratchet (10) includes a conventional handle (12), a conventional ratchet pawl (24), an output shaft (16), and at least one output shaft sleeve (30). Each output shaft sleeve (30) defines a square cross section with an inner wall (36) dimensioned to closely receive the output shaft (16) or a smaller sleeve (30), and an outer wall (38) dimensioned to be closely received within a socket wrench ratchet receptor or a larger sleeve (30). A base (46) is provided with each sleeve (30) for limiting the distance that sleeve (30) may be extended from the ratchet head (14). The base (46) is further used to eject the sleeve (30) from the ratchet head (14). A locking mechanism (20) is provided for locking the position of each sleeve (30) with respect to the output shaft (16) or the previous sleeve (30). A second locking mechanism (44) is provided for securing a socket wrench (26) to the sleeve (30).

8 Claims, 3 Drawing Sheets

CONVERSION RATCHET DRIVE

DESCRIPTION

1. Technical Field

This invention relates to the field of ratchet drives. More specifically, this invention relates to a ratchet drive provided with retractable socket output shaft sleeves for use with sockets of various socket receptor sizes.

2. Background Art

In the field of ratchets, it is well known that conventional sockets are provided with a ratchet receptor for securement of the socket to a ratchet. Conventional ratchets are provided with a socket output shaft to be received within the ratchet receptor. It is well known that ratchet receptors defined by various sockets are various in sizes, often dependent upon the size of the socket itself. Typical ratchets are provided with a single size socket output shaft such that for each size ratchet receptor, a separate ratchet is required. In order to overcome the need for various ratchets, removable adapters have been provided.

Several ratchets have been produced having a plurality of output shafts for various purposes. Typical of the art are those devices disclosed in the following U.S. Patents:

| U.S. Pat. No. | Inventor(s) | Issue Date |
|---|---|---|
| 1,807,134 | E. M. Pfauser | May 26, 1931 |
| 1,873,472 | E. M. Pfauser | Aug. 23, 1932 |
| 2,803,980 | I. R. Vogel | Aug. 27, 1957 |
| 3,490,317 | W. J. Rozmus | Jan. 20, 1970 |
| 4,631,989 | C. A. Trowbridge, et al. | Dec. 30, 1986 |
| 5,211,087 | R. Thomason | May 18, 1993 |

Of these devices, those disclosed by Pfauser ('134 and '472) are provided with a shaft extendable from either direction from a head defined at the end of a handle. The head is ratcheted with respect to the handle in only one direction. The ratchet is reversible by reversing the extension of the shaft. However, Pfauser does not provide a means for employing the devices with various sized ratchet receptors.

Rozmus ('317) discloses a dual driver ratchet having dual drive gears, each defining a square receptor. The two receptors define different side lengths for the receipt of two different size male drive members. However, conventional sockets do not define male drive members, and thus, implementation of the '317 device requires an adaptor shaft. Further, use of the two drive gears is directionally opposed in that one turns clockwise while the other turns counterclockwise, and vice versa. This opposition can be confusing.

The '980 device disclosed by Vogel defined a reversible head having a fixed shaft extending from each side, each shaft defining a different side length. Thus, selection of the shaft size is made by simply turning the handle over. However, the Vogel device is limited to two sizes. Further, because the shafts extend from both sides of the ratchet, the ratchet direction must be reversed when alternating between shaft sizes.

Those devices disclosed by Trowbridge, et al. ('989) and Thomason ('087) include shafts extending from either side of the ratchet head. The '989 device is provided with a set screw for alternating between two sizes of shafts on one side of the head, the small shaft being retracted within the larger shaft when the larger shaft is used. When the smaller shaft is retracted within the larger shaft, a distal end of the smaller shaft extends from the ratchet head on the opposite side, thus effectively producing a ratchet substantially similar to that of Vogel ('980) as discussed above. Similarly, Thomason incorporates an axially shiftable output shaft defining various sized shaft portions.

None of the prior art made of record discloses a ratchet having various sized output shafts each extending from a common side of the ratchet head such that directional changes are not required when changing from one sized shaft to another. Further, the prior art made of record fails to disclose a single output shaft having at least one retractable and extendable sleeve for altering the size of the output shaft.

Therefore, it is an object of this invention to provide a means for a ratchet having a single output shaft provided with a means for varying the size thereof for accommodating sockets having various sized ratchet receptors.

Further, it is an object of the present invention to provide such a ratchet whereby the output shaft extends from one side of the ratchet head such that directional opposition between the various sized output shafts is eliminated.

DISCLOSURE OF THE INVENTION

Other objects and advantages will be accomplished by the present invention which is provided for use with socket wrenches having various sizes of ratchet receptors, the ratchet being provided with at least one output shaft sleeve for adjusting the side length thereof. The ratchet is provided with an output shaft which extends from the same side of the ratchet head as each of the output shaft sleeves. The ratchet includes a conventional handle, a conventional ratchet pawl, an output shaft, and at least one output shaft sleeve. Each output shaft sleeve defines a square cross section with an inner wall dimensioned to closely receive the output shaft or a smaller sleeve, and an outer wall dimensioned to be closely received within a socket wrench ratchet receptor or a larger sleeve.

A base is provided with each sleeve for limiting the distance that sleeve may be extended from the ratchet head. The base is further used to eject the sleeve from the ratchet head. Four connecting members are provided for securing the base to the sleeve. A locking mechanism is provided for locking the position of the smallest sleeve with respect to the output shaft. A spring biased bearing is carried within the output shaft for locking the smallest, or first, sleeve in an extended position, or for locking a socket wrench to the output shaft. Each sleeve defines a through opening for receiving either the spring biased bearing carried with in the output shaft or a smaller sleeve. In order to aid in retracting and extending the sleeve, a groove is defined on the inside wall of the sleeve from the through opening to the distal end of the sleeve.

Each sleeve is provided with a second locking mechanism for securing a socket wrench to the sleeve. A groove is defined by the output shaft or a previous sleeve from a midpoint on one side and terminates within the ratchet head. A further spring biased bearing is provided for locking a socket wrench to the sleeve in a conventional manner.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
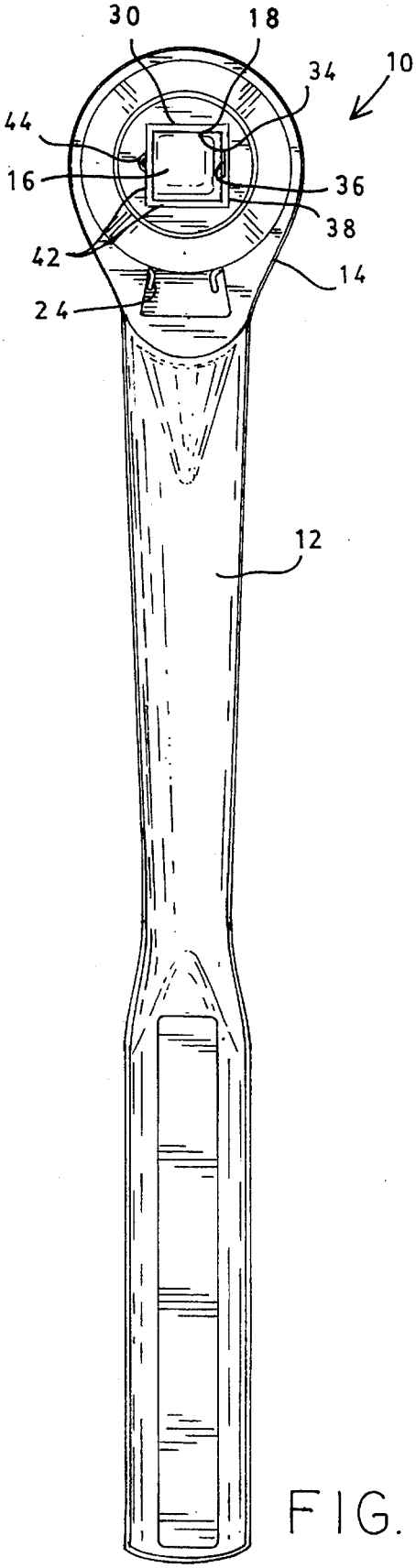
FIG. 1 is a plan view of the conversion ratchet drive constructed in accordance with several features of the present invention illustrating the output shaft and one extendable sleeve.

A conversion ratchet drive incorporating various features of the present invention is illustrated generally at 10 in the figures. The conversion ratchet drive, or ratchet 10, is designed for use with socket wrenches 26 having various sizes of ratchet receptors 28, the ratchet 10 being provided with at least one output shaft sleeve 30 for adjusting the side length thereof. Moreover, in the preferred embodiment the ratchet 10 is provided with an output shaft 16 which extends from the same side of the ratchet head 14 as each of the output shaft sleeves 30.

The ratchet 10 of the present invention is provided with a conventional handle 12, a conventional ratchet pawl 24, an output shaft 16, and at least one output shaft sleeve 30. The output shaft 16 is secured to the ratchet pawl 24 in a conventional manner such that as the ratchet pawl 24 is operated, the output shaft 16 and the socket wrench 26 are rotated accordingly with respect to the ratchet handle 12. FIGS. 1-9 illustrate a ratchet 10 having one output shaft sleeve 30. As illustrated best in FIG. 1, the output shaft sleeve 30 defines a square cross section with an inner wall 36 dimensioned to closely receive the output shaft 16 and an outer wall 38 dimensioned to be closely received within a socket wrench ratchet receptor 28.

Figure 2:
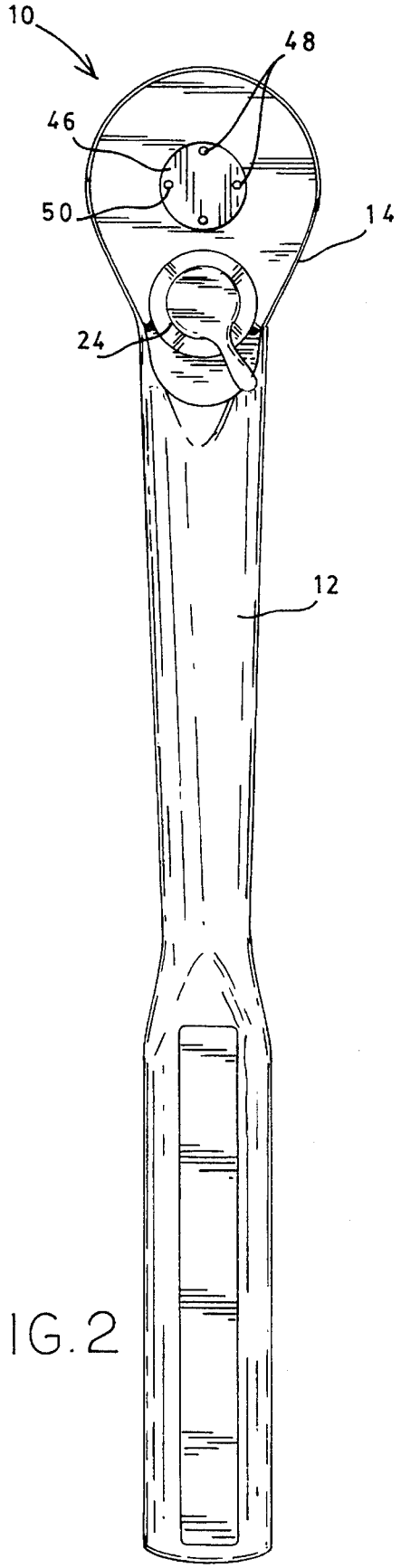
FIG. 2 is a plan view of the conversion ratchet drive illustrating the base of the retractable sleeve shown in FIG. 1.

As illustrated in FIG. 2, a base 46 is provided for limiting the distance the sleeve 30 may be extended from the ratchet head 14. The base 46 is further used to eject the sleeve 30 from the ratchet head 14. In the illustrated embodiment, four pins 48 are provided for securing the base 46 to the sleeve 30, each pin 48 being secured at one end 50 to the base 46 and at the other end 52 to the sleeve 30 at a midpoint of one of the sides 42.

Figure 3:
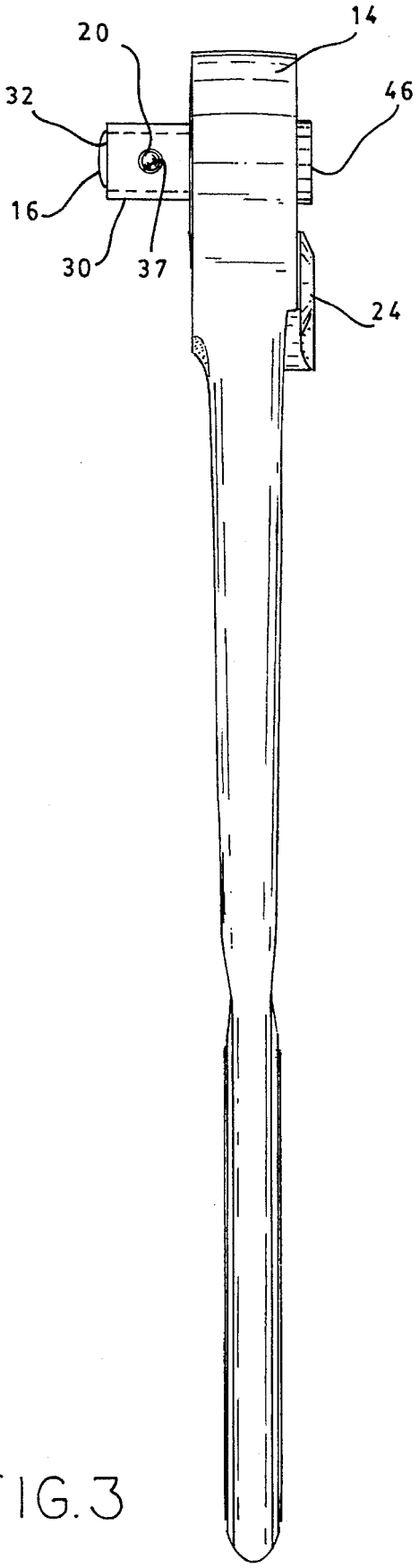
FIG. 3 is a side view of the conversion ratchet drive as illustrated in FIG. 1 with one retractable sleeve shown extended from the ratchet head.
Figure 4:
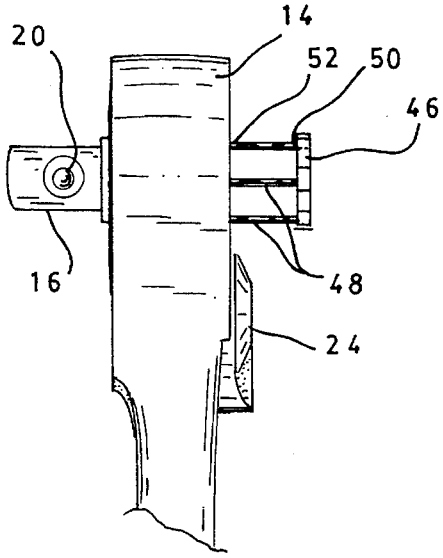
FIG. 4 is a partial side view of the conversion ratchet drive illustrating the sleeve of FIG. 3 being retracted within the ratchet head.

FIGS. 3 and 4 more clearly illustrate a first locking mechanism provided for locking the position of the sleeve 30 with respect to the output shaft 16. A first spring biased bearing 20 is carried within the output shaft 16 for locking the sleeve 30 in an extended position, or for locking a socket wrench 26 to the output shaft 16. The sleeve 30 defines a through opening 37 for receiving the first spring biased bearing 20 when the sleeve 30 is in the extended position. In order to aid in retracting and extending the sleeve 30, a groove 40 is defined on the inside wall 36 of the sleeve 30 from the through opening 37 to the distal end 32 of the sleeve 30, as illustrated in FIG. 1. When the sleeve 30 is extended from the ratchet head 14, the same may be retracted by applying an axial force on the distal end 32 of the sleeve 30, as by pushing on to the output shaft 16 a socket wrench 26 having a ratchet receptor 28 dimensioned to closely receive the output shaft 16. In the position illustrated in FIG. 3, the sleeve, 30 may be extended from the ratchet head 14 by application of an axial force on the base 46. However, when the sleeve 30 is retracted within the ratchet head 14 as illustrated in FIG. 4, the first spring biased bearing 20 is used to secure a socket wrench 26 as in conventional ratchets.

Figure 5:
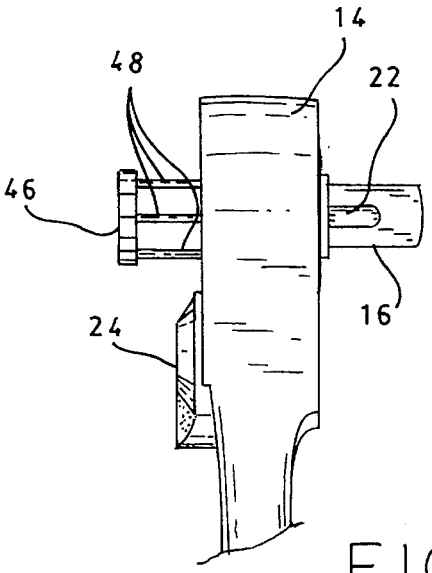
FIG. 5 is an opposing partial side view of the conversion ratchet drive as illustrated in FIG. 4 illustrating a portion of the locking mechanism for locking the position of the sleeve in relation to the output shaft.
Figure 6:
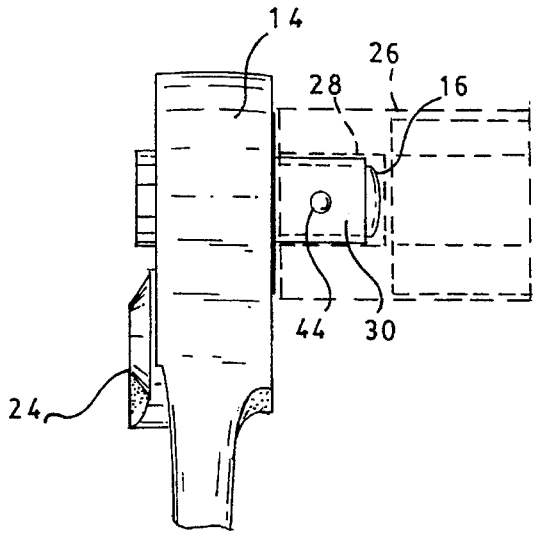
FIG. 6 is a partial side view of the present invention showing the sleeve extended and further showing a cooperating portion of the locking mechanism partially illustrated in FIG. 5.

FIGS. 5 and 6 illustrate a second locking mechanism for securing a socket wrench 26 to the sleeve 30. A groove 22 is defined by the output shaft 16 from a midpoint on one side 18 and terminates within the ratchet head 14. As illustrated in FIG. 6, a second spring biased bearing 44 is provided for lacking a socket wrench 26 to the sleeve 30.

Figure 7:
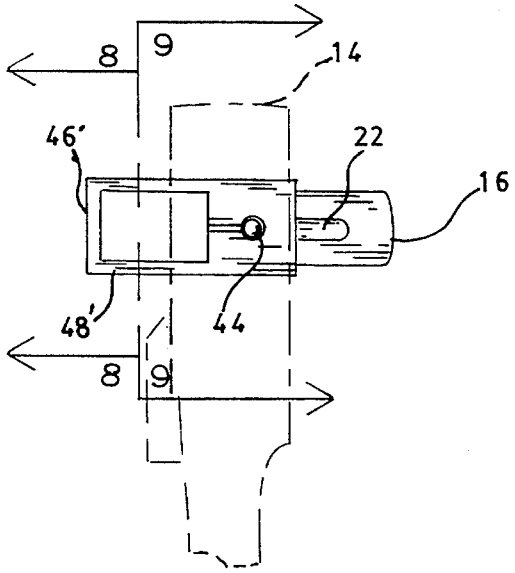
FIG. 7 illustrates an alternate embodiment of a retractable sleeve incorporated in the conversion ratchet derive of the present invention.
Figure 8:
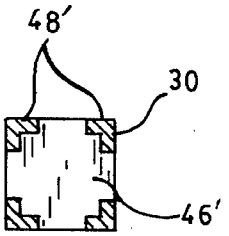
FIG. 8 illustrates an end view of the sleeve, in section taken along 8—8 of FIG. 7.
Figure 9:
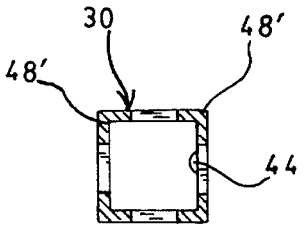
FIG. 9 illustrates an end view of the sleeve, in section taken along 9—9 of FIG. 7.

Illustrated in FIGS. 7–9, the base 46' defines a square cross-section and is formed integrally with four connecting posts 48' and the sleeve 30. Each connecting post 48' defines an angled member and is disposed proximate one comer of the base 46' and the sleeve 30.

Figure 10:
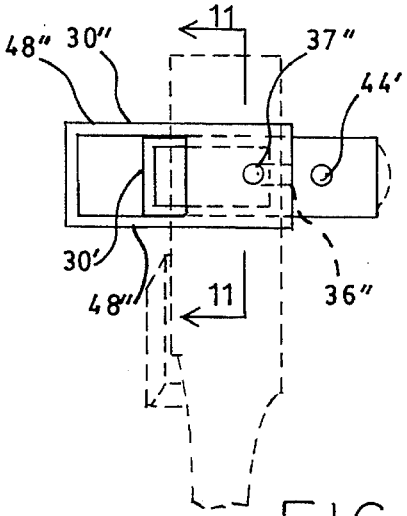
FIG. 10 illustrates a partial side view of a further alternate embodiment wherein two output shaft sleeves are provided.
Figure 11:
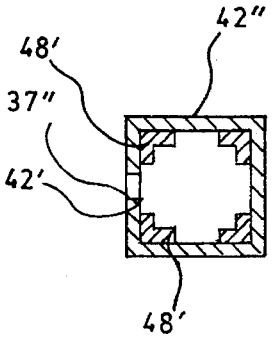
FIG. 11 is an end view, in section, of the alternate embodiment of the present invention taken along 11—11 of FIG. 10.

As illustrated in FIGS. 10 and 11, an alternate embodiment of the present invention further includes a second sleeve 30" for providing a third effective output shaft size. In this embodiment, a first sleeve 30' is substantially similar to the sleeve 30 described above, with the exception of a groove 40 defined from a midpoint of one side 42 and terminating within the ratchet head 14. A third spring biased bearing 44' is provided for being received within an opening 37" defined by the second sleeve 30" and for engaging a conventional socket wrench 26. The groove 40 is configured to slidably receive the third spring biased bearing 44'. A groove 36" is defined by the interior wall 34" of the second sleeve 30" from the midpoint to the distal end 32" thereof for slidably receiving the second spring biased bearing 44. Thus, the second spring biased bearing 44 serves to lock the relative positions of the first and second sleeves 30',30".

Although not illustrated, more sleeves 30 may be provided in similar fashion to that described above. Specifically, one sleeve 30 must define a groove 36 from the midpoint of the inner wall 34 thereof and terminating at the distal end 32 for receiving the spring biased member 44,20 the next smaller sleeve 30 or the output shaft 16, respectively, in order to lock the position of the sleeve 30 in the extended position. Further, the next smaller sleeve 30 must define a groove 40 from a midpoint on another side 42 and terminating within the ratchet head 14 for slidably receiving the locking mechanism provided by the next sleeve 30 to secure a socket wrench 26 thereto.

From the foregoing description, it will be recognized by those skilled in the art that a conversion ratchet drive offering advantages over the prior art has been provided. Specifically, the conversion ratchet drive provides a means for effectively varying the size of an output shaft provided by a ratchet drive. By effectively varying the size of a single output shaft, the use of the ratchet is made simple as compared to devices wherein several shafts are provided and wherein shafts are provided on either side of the ratchet head. By providing the variably-sized output shaft, each size is operable in similar fashion, without reversing the direction of operation for each successive size.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. A ratchet for driving a conventional socket wrench defining a ratchet receptor, said ratchet comprising:

a conventional handle defining a ratchet head at a distal end thereof;

a conventional ratchet pawl carried within said ratchet head;

an output shaft secured at one end to said ratchet pawl and extending away from a first side of said ratchet head, said output shaft defining a groove on a first side from a midpoint thereof and terminating within said ratchet head, said output shaft being dimensioned to be closely received by a first socket wrench having a ratchet receptor of a first size;

a first locking mechanism carried by said output shaft, said first locking mechanism including a first bearing biased away from said output shaft, said first bearing being disposed on a second side of said output shaft to releasably engage the first socket wrench;

at least one sleeve retractable within said ratchet head, said at least one sleeve defining an annular configuration having an inner wall dimensioned to closely receive said output shaft and an outer wall dimensioned to be closely received by the socket wrench ratchet receptor, said at least one sleeve defining an inner wall groove on a first side corresponding to said output shaft second side and disposed to slidably receive said first bearing, said at least one sleeve defining a through opening on said first side and positioned to receive said first bearing when said at least one sleeve is extended from said ratchet head, said inner wall groove extending from said through opening to a distal end of said at least one sleeve; and a second locking mechanism carded by said at least one sleeve, said second locking mechanism including a second bearing biased away from said at least one sleeve, said second bearing being disposed on a second side of said at least one sleeve to releasably engage a socket wrench having a ratchet receptor of a second size.

2. The ratchet of claim 1 wherein said second side of said at least one sleeve corresponds to said first side of said output shaft, said second bearing being slidably received within said output shaft groove to facilitate retraction of said at least one sleeve within said ratchet head.

3. The ratchet of claim 1 wherein said at least one sleeve includes a base disposed on a second side of said ratchet head, a plurality of connecting members being provided for securement of said base to said at least one sleeve, each of said plurality of connecting members being received through said ratchet head and said ratchet pawl.

4. The ratchet of claim 1 wherein said at least one sleeve includes at least one intermediate sleeve and an outer sleeve, a first of said at least one intermediate sleeve receiving said output shaft, each said at least one intermediate sleeve defining a groove on a side of said outer wall corresponding to said second side of an adjacent said inner wall of another said at least one sleeve, said outer wall groove being configured to slidably receive said second locking mechanism associated with said another said at least one sleeve to facilitate retraction of said another said at least one sleeve into said ratchet head, said at least one intermediate sleeve being dimensioned to be closely received by a socket wrench.

5. The ratchet of claim 1 wherein said at least one sleeve includes an intermediate sleeve and an outer sleeve, said intermediate sleeve receiving said output shaft, said intermediate sleeve defining a groove on a side of said outer wall corresponding to said second side of said inner wall of outer sleeve, said outer wall groove being configured to slidably receive said second locking mechanism associated with said outer sleeve to facilitate retraction of said outer sleeve into said ratchet head, said inner sleeve being dimensioned to be closely received by said second socket wrench, said outer sleeve being dimensioned to be closely received by a third socket wrench having a ratchet receptor of a third size.

6. A ratchet for driving a conventional socket wrench defining a ratchet receptor, said ratchet comprising:

a conventional handle defining a ratchet head at a distal end thereof;

a conventional ratchet pawl carried within said ratchet head;

an output shaft secured at one end to said ratchet pawl and extending away from a first side of said ratchet head, said output shaft defining a groove on a first side from a midpoint thereof and terminating within said ratchet head, said output shaft being dimensioned to be closely received by a first socket wrench having a ratchet receptor of a first size;

a first locking mechanism carried by said output shaft, said first locking mechanism including a first beating biased away from said output shaft, said first bearing being disposed on a second side of said output shaft to releasably engage the first socket wrench;

at least one intermediate sleeve retractable within said ratchet head, said at least one intermediate sleeve defining an annular configuration having an inner wall dimensioned to closely receive one of said output shaft and said at least one intermediate sleeve and an outer wall dimensioned to be closely received by the socket wrench ratchet receptor, said at least one intermediate sleeve defining an inner wall groove on a first side, said at least one sleeve defining a through opening on said first side, said inner wall groove extending from said through opening to a distal end of said at least one intermediate sleeve, said at least one intermediate sleeve including a base disposed on a second side of said ratchet head, a plurality of connecting members being provided for securement of said base to said at least one intermediate sleeve, each of said plurality of connecting members being received through said ratchet head and said ratchet pawl, a first intermediate sleeve receiving said output shaft, said inner wall groove of said first intermediate sleeve being provided for slidably receiving said first bearing;

an outer sleeve retractable within said ratchet head, said outer sleeve defining an annular configuration having an inner wall dimensioned to closely receive said at least one intermediate sleeve and an outer wall dimensioned to be closely received by the socket wrench ratchet receptor, said outer sleeve defining an inner wall groove on a first side, said outer sleeve defining a through opening on said first side, said inner wall groove extending from said through opening to a distal end of said outer sleeve, said outer sleeve including a base disposed on a second side of said ratchet head, a plurality of connecting members being provided for securement of said base to said outer sleeve, each of said plurality of connecting members being received through said ratchet head and said ratchet pawl; and a plurality of second locking mechanisms carried by said at least one intermediate sleeve and said outer sleeve, each of said plurality of second locking mechanisms including a second bearing biased away from said at least one intermediate sleeve and said outer sleeve, said second bearing being disposed on a second side of said at least one intermediate sleeve and said outer sleeve to releasably engage a socket wrench, each said at least one intermediate sleeve defining a groove on a side of said outer wall corresponding to said second side of an adjacent said inner wall of another said at least one sleeve, said outer wall groove being configured to slidably receive said second locking mechanism associated with said another said at least one sleeve to facilitate retraction of said another said at least one sleeve into said ratchet head.

7. The ratchet of claim 6 wherein said second side of said at least one sleeve corresponds to said first side of said output shaft, said second bearing being slidably received within said output shaft groove to facilitate retraction of said at least one sleeve within said ratchet head.

8. The ratchet of claim 6 wherein said at least one sleeve includes an intermediate sleeve and an outer sleeve, said intermediate sleeve receiving said output shaft, said intermediate sleeve defining a groove on a side of said outer wall corresponding to said second side of said inner wall of outer sleeve, said outer wall groove being configured to slidably receive said second locking mechanism associated with said outer sleeve to facilitate retraction of said outer sleeve into said ratchet head, said inner sleeve being dimensioned to be closely received by said second socket wrench, said outer sleeve being dimensioned to be closely received by a third socket wrench having a ratchet receptor of a third size.

* * * * *